US006244808B1

(12) United States Patent
Donhauser

(10) Patent No.: US 6,244,808 B1
(45) Date of Patent: Jun. 12, 2001

(54) SHANK GROOVE CONFIGURATION FOR A RIVET

(75) Inventor: Georg Donhauser, Amberg (DE)

(73) Assignee: Kerb-Konus-Vertriebs-GmbH, Amberg (DE)

( * ) Notice: Subject to any disclaimer, the term of this patent is extended or adjusted under 35 U.S.C. 154(b) by 0 days.

(21) Appl. No.: 09/468,057

(22) Filed: Dec. 20, 1999

(30) Foreign Application Priority Data

Dec. 21, 1998 (DE) ..... 298 22 745 U

(51) Int. Cl.[7] ..... F16B 19/06; F16B 37/04
(52) U.S. Cl. ..... 411/504; 411/179; 411/360
(58) Field of Search ..... 411/179, 361, 411/500, 504, 360

(56) References Cited

U.S. PATENT DOCUMENTS 3,909,913 * 10/1975 Tildesley ..... 411/179 X
4,978,270 * 12/1990 Ackerman ..... 411/504 X
5,678,970 * 10/1997 Caulk ..... 411/504

FOREIGN PATENT DOCUMENTS 1 252 615 10/1967 (DE) .
36 40 484 6/1988 (DE) .

OTHER PUBLICATIONS

Stanznieten ist zukunfttrachtig in der Blechverarbeitung by Lothar Budde and Wilhelm Lappe, 1991 (pp. 94–100).

* cited by examiner

*Primary Examiner*—Neill Wilson
(74) *Attorney, Agent, or Firm*—Flynn, Thiel, Boutell & Tanis, P.C.

(57) ABSTRACT

A punching, stamping rivet has a frustrum-shaped rivet head and a shank with a shank groove following thereafter. In order to create a riveted joint between two sheets, the sheets are punched through by the shank. A groove is subsequently stamped around the shank end in the lower sheet, thus pressing material of the lower sheet into the groove. In order to increase the strength of the riveted joint, the shank groove is concavely constructed, whereby the section of the groove, which section is adjacent the rivet head, extends at an angle with respect to the shank axis, which angle is less than an angle at which the section adjacent the shank end extends with respect to the shank axis.

16 Claims, 1 Drawing Sheet

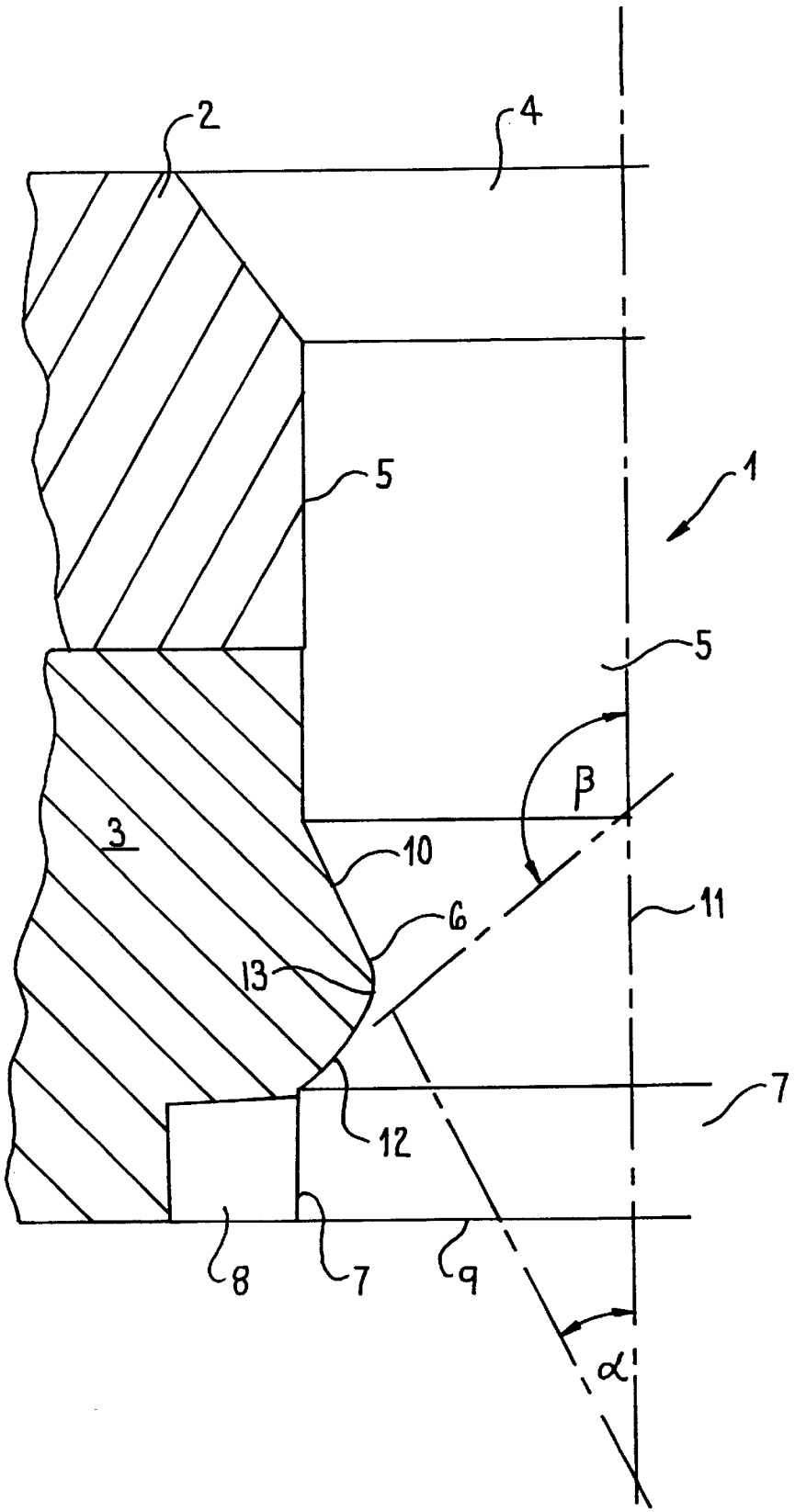
2
4
5
1
5
β
3
10
11
6
13
7
12
8
7
9
α

SHANK GROOVE CONFIGURATION FOR A RIVET

FIELD OF THE INVENTION

The invention relates to a punching, stamping rivet including a rivet head, shank, and a groove in the shank.

BACKGROUND OF THE INVENTION

Punching, stamping rivets are used to connect two flat workpieces. The shank of the rivet is hereby pressed (punched) through the workpieces forming two punched holes. The lower workpiece, viewed in punching direction, consists of a plastically deformable material, usually a sheet metal. The shank has a shank groove near the shank end. An annular ring is stamped after the punching operation around the shank end into the lower workpiece by a press tool, thus pressing material of the lower workpiece into the shank groove.

The shank groove has in the case of a known rivet a trapezoidal shape in cross section. When workpieces of a hard material are processed, then there exists the danger that the shank will break in the area of the shank groove. When the upper workpiece consists of a soft material, as, for example, of a soft sheet metal or plastic, then material is sheared off from the upper workpiece by the upper edge of the shank groove and is pressed into the shank groove. The material-receiving space for receiving the material of the lower workpiece is thus reduced and a poor riveted joint is created. When the upper workpiece consists of plastic, then the entire shank groove may be filled with plastic so that a riveted joint is not created. The stamping rivets are manufactured as a turned part, for example on a lathe.

Two factors are, among others, of importance for the strength of the riveted joint. The first factor is that the shank groove is supposed to be filled totally and exclusively with material of the lower workpiece. The second factor is the angle at which the section (surface) of the shank groove, which section is adjacent the shank and, extends. Ideal would be here an approximation to an angle of 90° which, however, would significantly increase the above-mentioned danger of breakage.

SUMMARY OF THE INVENTION

The purpose of this invention is to provide a rivet wherein the strength of the riveted joint is increased without the above-mentioned disadvantages occurring.

This purpose is attained by providing a concave shank groove. The section of the groove adjacent the rivet head extends at an angle less than the angle of the section of the groove adjacent the nonheaded or distal shank end.

The rivet of the present invention can also include a rounded transition from the outer surface of the shank to the groove section adjacent the rivet head. Additionally, the rivet of the present invention can further include a sharp edged transition from the section adjacent the nonheaded shank end to the outer surface of the shank. Moreover, the rivet can include a rounded transition between the two sections of the groove.

In the rivet of the present invention, the section of the groove adjacent the rivet head can extend at an angle of approximately 15° with respect to the shank axis. The section of the groove adjacent the nonheaded shank end is greater than 90°, and preferably about 120°.

BRIEF DESCRIPTION OF THE DRAWING

One exemplary embodiment will be discussed in greater detail hereinafter in connection with the drawing, which illustrates a cross-sectional view of the left half of a riveted joint.

DETAILED DESCRIPTION

The punching, stamping rivet is identified in its entirety by the reference numeral 1. The riveted joint created with the rivet 1 connects an upper sheet metal part 2 with a lower sheet metal part 3. The rivet 1 has a frustrum-shaped rivet (countersunk) head 4 and a shank 5 fixed thereto and extending therefrom. The shank 5 has a shank groove 6 and a cylindrical section 7 oriented between the shank groove 6 and a distal end 9 of the shank 5.

In order to create the riveted joint, the rivet is pressed (punched) from above downwardly through the sheet metal parts 2, 3, thus creating aligned punched holes in the sheet metal parts 2, 3. After the stamping process has ended, a groove 8 is stamped around the section 7 by means of an annular press tool, which causes the material of the lower sheet metal 3 to be pressed into the shank groove 6 while being plastically deformed so as to fill the groove 6.

This shank groove 6 is concavely inset into the shank. However, it has a cross sectional shape deviating from a circular shape to correspond approximately with a tear drop shape. The upper section 10 of the annular groove 6, which section is adjacent the rivet head 4, extends into the shank forming a relatively flat angle $\alpha$ with respect to the axis 11 of the rivet 1. The lower section 12 of the rivet groove 6, which lower section is adjacent the rivet nonhead or distal end 9, extends forming an angle $\beta$ with respect to the axis 11. The angle $\beta$ is greater than 90°. Thus the inclination of the upper section 10 corresponds with the angle $\alpha$, whereas the inclination of the lower section 12 has a complementary angle equal to $180°-\beta$. This complementary angle is always greater than the angle $\alpha$.

The annular groove 6 has a rounded section 13 between the two sections 10, 12. The transition between the section 10 and the shank S can also be rounded, whereas the transition from the section 12 of the annular groove 6 to the section 7 of the shank 5 can be constructed sharp-edged.

The flat length of the section 10 relative to the surface of the shank 5 guarantees that no material is sheared off the sheet metal part 2 during the punching process and penetrates into the groove 6. The relatively steep extent of the section 12 of the groove 6 is of a significant influence for the strength of the riveted joint. The angle $\beta$ is greater than 90° and the closer it comes to this value the higher the resulting strength of the riveted joint. The boundary of the angle $\beta$ is determined mainly by the hardness of the material of the sheet metal 3. The boundary should be chosen such that a breakage of the rivet shank in the area of the groove 6 does not occur.

Although a particular preferred embodiment of the invention has been disclosed in detail for illustrative purposes, it will be recognized that variations or modifications of the disclosed apparatus, including the rearrangement of parts, lie within the scope of the present invention.

The invention claimed is:

1. A punching, stamping rivet with a frustrum-shaped rivet head and a shank following thereafter, which shank has a shank groove, whereby in order to create a riveted joint between at least two adjoining structural parts, the shank punches through the structural parts forming a punched hole and a groove is subsequently stamped in the structural part around the shank end, which causes material of the structural part to penetrate under a plastic deformation into the shank groove, wherein the shank groove is designed concavely and a first section of the shank groove, which section is adjacent the rivet head, extends at a flatter angle with respect to the shank axis than does a section of the shank groove, which section is adjacent a distal end of the shank.

2. The punching, stamping rivet according to claim 1, wherein a transition between the shank and the first section of the annular groove, which section is adjacent the rivet head, is rounded.

3. The punching, stamping rivet according to claim 2, wherein a transition between the shank and the second section of the shank groove, which section faces the shank end, is constructed sharp-edged.

4. The punching, stamping rivet according to claim 2, wherein a transition between the first and second sections of the shank groove is rounded.

5. The punching, stamping rivet according to claim 2, wherein the first section of the annular groove, which section is adjacent the rivet head, is inclined at an angle of approximately 15° with respect to the shank axis.

6. The punching, stamping rivet according to claim 2, wherein the second section of the shank groove, which section is adjacent the shank end, is inclined at an angle of greater than 90°.

7. The punching, stamping rivet according to claim 6, wherein the angle is approximately 120°.

8. The punching, stamping rivet according to claim 1, wherein a transition between the shank and the second section of the shank groove, which section faces the shank end, is constructed sharp-edged.

9. The punching, stamping rivet according to claim 8, wherein a transition between the first and second sections of the shank groove is rounded.

10. The punching, stamping rivet according to claim 9, wherein the first section of the annular groove, which section is adjacent the rivet head, is inclined at an angle of approximately 15° with respect to the shank axis.

11. The punching, stamping rivet according to claim 10, wherein the second section of the shank groove, which section is adjacent the shank end, is inclined at an angle of greater than 90°.

12. The punching, stamping rivet according to claim 11, wherein the angle is approximately 120°.

13. The punching, stamping rivet according to claim 1, wherein a transition between the first and second sections of the shank groove is rounded.

14. The punching, stamping rivet according to claim 1, wherein the first section of the annular groove, which section is adjacent the rivet head, is inclined at an angle of approximately 15° with respect to the shank axis.

15. The punching, stamping rivet according to claim 1, wherein the second section of the shank groove, which section is adjacent the shank end, is inclined at an angle of greater than 90°.

16. The punching, stamping rivet according to claim 15, wherein the angle is approximately 120°.

* * * * *